US006428369B1

(12) United States Patent
Jones

(10) Patent No.: US 6,428,369 B1
(45) Date of Patent: Aug. 6, 2002

(54) JET-PROPELLED BOAT HAVING THROUGH-HULL HOUSING FOR SHAFT PENETRATION

(75) Inventor: James R. Jones, Neosho, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/723,983

(22) Filed: Nov. 28, 2000

(51) Int. Cl.[7] ..... B63H 11/00
(52) U.S. Cl. ..... 440/38; 440/112
(58) Field of Search ..... 114/221 R, 197, 114/198; 440/38, 112

(56) References Cited

U.S. PATENT DOCUMENTS 5,372,526 A * 12/1994 Ozawa et al. ..... 440/112
6,315,623 B1 * 11/2001 Hedlund ..... 440/112

* cited by examiner

*Primary Examiner*—Jesus D. Sotelo
(74) *Attorney, Agent, or Firm*—Ostrger Chong & Flaherty LLP

(57) ABSTRACT

A jet-propelled boat having an inboard motor and a hull which incorporates an inlet ramp penetrated by a driven shaft. The driven shaft couples a drive shaft of the inboard motor to an impeller of a water jet propulsion assembly which is mounted in cantilever fashion to the hull transom. The hull penetration is accomplished by a through-hull housing which is installed in an opening formed in the hull inlet ramp. Preferably the through-hull housing is made of thick metal plate with a transverse linear bore for shaft penetration and a peripheral flange which seats in a peripheral recess formed along the edge of the opening in the inlet ramp. The through-hull housing is clamped to the recessed hull edge, which forms the opening in the inlet ramp, by an annular clamp plate. An inlet grate extending from the outboard surface of the through-hull housing. A through-hull housing and inlet grate assembly is installed in the hull opening as a module.

30 Claims, 3 Drawing Sheets

JET-PROPELLED BOAT HAVING THROUGH-HULL HOUSING FOR SHAFT PENETRATION

FIELD OF THE INVENTION

This invention generally relates to water jet-propelled boats or watercraft having an inboard motor and an outboard water jet propulsion unit. In particular, the invention relates to apparatus for penetrating a hull of a boat or watercraft with a driven shaft, the input end of the driven shaft being coupled to the drive shaft of an inboard motor and the output end of the driven shaft being coupled to the impeller of a water jet propulsion unit.

BACKGROUND OF THE INVENTION

It is known to propel a boat or other watercraft using a water jet apparatus mounted to the hull, with the powerhead being placed inside (inboard) the hull. The driven shaft of the water jet apparatus is coupled to the drive shaft of the inboard motor. The impeller is mounted on the driven shaft and housed in a jet propulsion duct or water tunnel or housing.

To facilitate use of water jet-propelled boats in shallow water, it is known to mount the water jet propulsion assembly at an elevation such that the unit does not project below the bottom of the boat hull. This can be accomplished, for example, by installing a duct in the stern of the boat, the duct being arranged to connect one or more inlet holes formed in the bottom of the hull with an outlet hole formed in the transom. The water jet propulsion assembly is then installed outside the hull in a position such that its inlet is in flow communication with the duct outlet at the transom. Alternatively, the water jet impeller can be installed inside the duct built into the hull.

It is further known to integrally form an inlet ramp or tunnel in the stern portion of the bottom of a molded hull. The inlet ramp comprises a pair of opposing side walls which increase in height continuously from a starting point on the hull bottom to the respective points where the side walls join the hull transom. The top edges of the opposing side walls are connected by a ramp ceiling which curves continuously upward. The side walls and ceiling form part of the molded hull bottom and define an inlet channel. Optionally, the junctures connecting the side walls to the ceiling may be formed as rounded, as opposed to sharp, corners. A mounting adapter in the form of a flanged ring having a rounded leading lower lip is mounted to the rear face of the hull transom. The bottom edges of the inlet ramp and the forward tip of the lower lip define an inlet opening for entry of ambient water into the inlet channel formed by the inlet ramp. The mounting adapter is mounted to the transom by fasteners. The water jet propulsion assembly is in turn mounted to the mounting adapter in cantilever fashion in a well-known manner. The outlet of a discharge nozzle of the water jet propulsion assembly is in flow communication with the inlet opening in the hull bottom via the hull inlet ramp, the mounting adapter, and one or more housings of the water jet propulsion assembly itself (e.g., an impeller housing and a stator housing). All of these components, communicating with each other in series, form a duct having a channel with an inlet and an outlet. Rotation of an impeller, driven by an inboard motor, produces flow through the duct in a well-known manner.

In accordance with the latter design, the driven shaft must penetrate the ceiling of the inlet ramp. There is a need for an apparatus or structure which would allow the driven shaft to penetrate the inlet ramp ceiling in a simple and elegant manner without compromising watertightness of the hull. Such a hull penetration apparatus should easy to install and relatively inexpensive to manufacture.

SUMMARY OF THE INVENTION

The present invention is directed to a jet-propelled boat having an inboard motor and a hull which incorporates an inlet ramp penetrated by a driven shaft. The driven shaft couples a drive shaft of the inboard motor to an impeller of a water jet propulsion assembly which is mounted in cantilever fashion to the hull transom.

In accordance with the preferred embodiments of the invention, the hull penetration is accomplished by a through-hull housing which is installed in an opening formed in the hull inlet ramp. Preferably the through-hull housing is made of metal (e.g., aluminum), structural plastic or reinforced fiberglass, while the hull is a molded fiberglass and resin laminate. However, the invention also has application in boat hulls made of metal or wood. The through-hull housing comprises a linear bore for passage of the driven shaft through the hull.

In accordance with one preferred embodiment, the through-hull housing comprises a thick plate with a transverse linear bore for shaft penetration and a peripheral flange which seats in a peripheral recess formed along the edge of the opening in the inlet ramp. The recess preferably faces outward from the exterior of the hull. The through-hull housing is clamped to the recessed hull edge, which forms the opening in the inlet ramp, by an annular clamp plate which is preferably installed on the inboard side of the hull. Suitable means are provided to seal against water leaking into the hull via the housing/hull interface.

The preferred embodiment further comprises an inlet grate extending from the outboard surface of the through-hull housing. The inlet grate is preferably a separate component attached to the through-hull housing. This through-hull housing and inlet grate assembly is installed in the hull opening as a module. However, if the housing is made of metal, then the housing and inlet grate may optionally be cast as a single metal component. The inlet grate preferably comprises a plurality of generally parallel cantilever tines extending across at least a portion of the inlet channel for blocking the admission of weeds and/or other debris into the water jet propulsion assembly. However, the present invention is not limited to any particular inlet grate structure or design. Optionally, the inlet grate can be pivotably mounted to the through-hull housing. By pivoting the inlet grate downward. The ends of the tines can be moved to a depth below a lower lip of the mounting adapter, clearing the tine ends of obstruction to allow entangled weeds and other debris to be slid off of the inlet grate during a grate clean-out operation.

In accordance with a further aspect of the preferred embodiment, the outboard end of the linear bore which penetrates the housing has an annular recess of increased diameter for receiving an end of a swaged tube, which is press-fit into the annular recess. This swaged tube extends rearward and is coaxial with the linear bore. In the fully assembled state, the swaged tube surrounds the driven shaft on the outboard side of the hull, the swaged functioning as a shroud for the shaft. The shaft shroud prevents weeds,; ropes or debris from becoming entangled around the rotating driven shaft.

In accordance with another aspect of the preferred embodiment, the through-hull housing comprises a boss penetrated by the linear bore for the driven shaft. A face seal surrounds the driven shaft on the inboard side is effectively anchored to the boss by means of a bellows, also penetrated by the driven shaft. The linear bore is sized to provide sufficient clearance for the driven shaft to rotate freely. The face seal blocks ingress of water into the hull via the linear bore. The anchoring of the seal by means of a bellows accommodates axial displacement and angular misalignment of the driven shaft relative to the linear bore.

In accordance with yet another aspect of the invention, one end of the driven shaft is coupled to the end of the motor drive by means of a shaft coupling which accommodates axial displacement and angular misalignment between the drive and driven shafts.

DETAILED DESCRIPTION OF THE PREFERRED EMBODIMENTS

Figure 1:
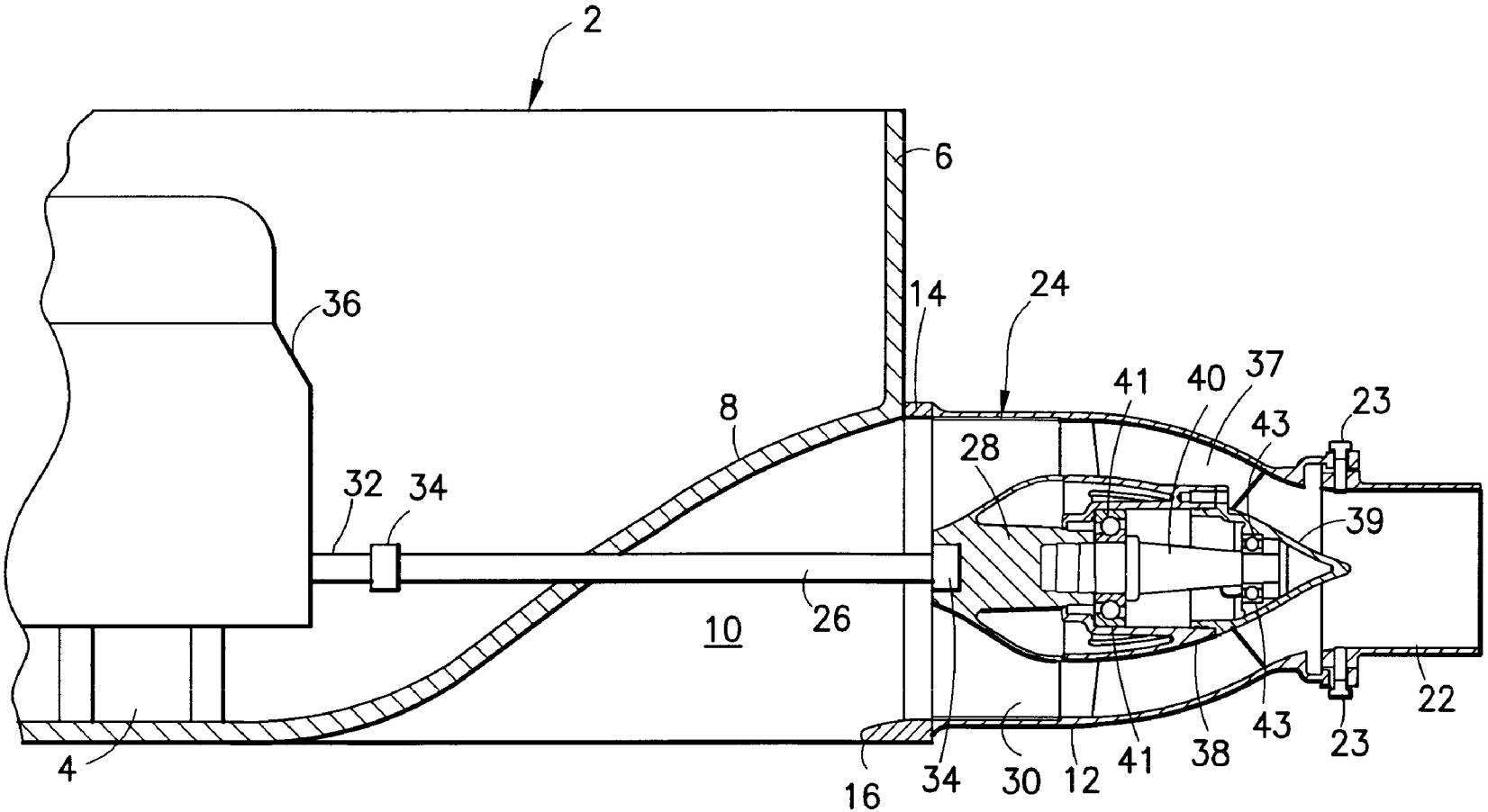
FIG. 1 is a schematic showing a sectional view of the stern portion of a water jet-propelled boat in which the ceiling of an inlet ramp integrated in a molded hull is penetrated by a driven shaft. The invention is not shown.

The stern portion of one type of jet-propelled boat is shown in FIG. 1. A hull 2 comprises a bottom 4, a stern wall or transom 6, an inlet ramp 8 integrally formed in the hull bottom, and a bow (not shown). Preferably the hull is fabricated in a mold by applying a lamination of fiberglass matting and resin and then allowing the laminate to cure. The inlet ramp 8 is formed as part of the hull bottom during the molding operation. The inlet ramp 8 increases continuously in height from a starting point at the hull bottom 4 to a maximum height at the transom 6. The inlet ramp defines an inlet channel 10 which is open at the hull bottom and at the transom.

In accordance with the boat design depicted in FIG. 1, a water jet propulsion assembly is mounted to the transom 6 by means of a mounting adapter 14. The water jet propulsion assembly is cantilevered from mounting adapter 14, which is mounted to the rear face of the transom 6 by fasteners (not shown). Preferably, mounting adapter 14 is a flanged ring having a rounded lower lip 16. The bottom edges of the inlet ramp 8 and the leading edge of the lower lip 16 define an inlet opening for entry of ambient water into the inlet channel 10.

The water jet propulsion assembly may, for example, comprise an integrally formed stator housing/exit nozzle 12 fastened to the mounting adapter 14. Alternatively, the stator housing and exit nozzle may be separate components. The exit nozzle discharges the impelled water into a steering nozzle 22. The steering nozzle is pivotably mounted to the exit nozzle in a conventional manner. The inlet of the steering nozzle 22 is in flow communication with the inlet opening via the inlet ramp 8, the mounting adapter 14, and the stator housing/exit nozzle 12.

As seen in FIG. 1, the water jet propulsion assembly typically comprises an impeller 24 coupled to the driven shaft 26 via a flexible coupling 34. The impeller typically comprises an impeller hub 28 coupled to a splined end of the driven shaft 26 for rotation therewith and a plurality of impeller blades 30 which extend generally radially outward from the hub. The impeller blades 30 are spaced at equal angular intervals around the circumference of the impeller hub 28. Preferably the hub and blades of impeller 24 are integrally formed as one cast piece. The outer surface of the impeller hub 28 forms a radially inner boundary for guiding the flow of water through the impeller housing.

Referring to FIG. 1, the driven shaft 26 is driven to rotate by a drive shaft 32 coupled thereto via another flexible coupling 34. The drive shaft 32 is driven to rotate by a motor 36 mounted inside the hull 2, which in turn causes the driven shaft and attached impeller to rotate. As generally depicted in FIG. 1, the driven shaft 26 penetrates the inlet ramp 8, although the means by which this penetration is accomplished are not shown.

Still referring to FIG. 1, the rotating impeller 24 impels water rearward into the stator section. The stator housing/exit nozzle 12 is preferably a cast piece which further comprises a stator hub 38 and a plurality of stator vanes 37 extending radially from the stator hub to the stator housing. A tail cone 39 is attached to the stator hub 38. The impeller hub 28 sits on the threaded end of a short shaft 40 which is rotatably supported by bearings 41 in the stator hub 38 and bearings 43 in the tail cone 39. The stator section restrains the free-spinning impeller from thrusting forward during operation. The outer surface of the stator hub 38 forms a radially inner boundary for guiding the flow of water through the stator housing/exit nozzle 12. The stator vanes 37 are designed to redirect the swirling flow out of the impeller 24 into non-swirling flow. The straightened flow flows through the convergent exit nozzle, which increases the water velocity.

Although FIG. 1 shows one housing for the impeller and stator sections, it will be readily appreciated by persons skilled in the art that separate housings may be used.

Still referring to FIG. 1, the steering nozzle 22 is pivotably mounted to the exit nozzle by means of a pair of pivot pins 23 which are coaxial with a vertical axis. This allows the steering nozzle 22 to be pivoted from side to side for directing thrust to one side or the other for the purpose of steering the boat. The water exiting the steering nozzle creates a reaction force which propels the boat forward. To simplify the drawing, the levers, rods and cables for controlling the angular position of steering nozzle 22 are not shown. Also, the reverse gate and associated levers, rods and cables have not been shown.

Figure 2:
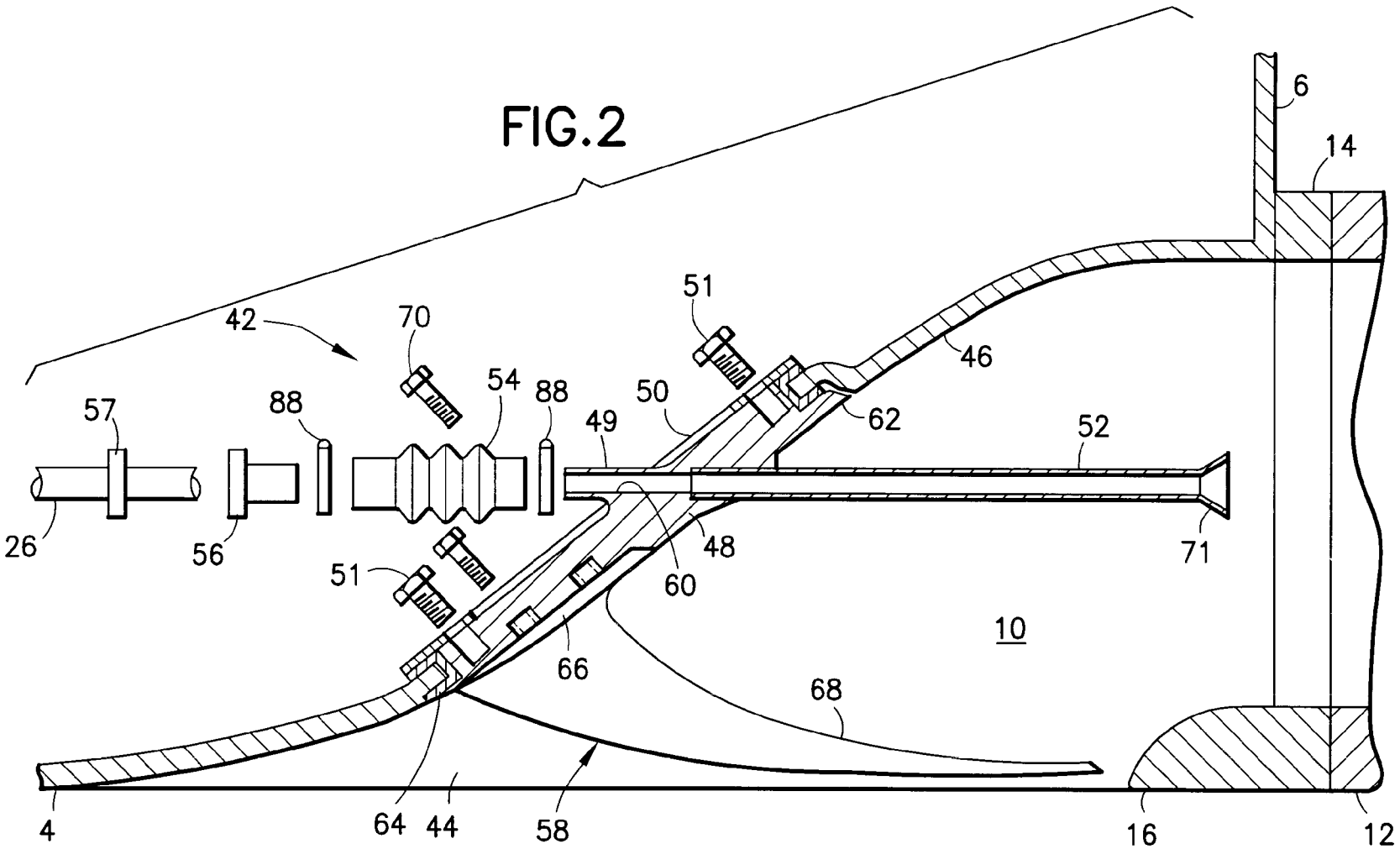
FIG. 2 is a schematic showing a partly sectional and partly exploded view of a through-hull housing assembly in accordance with the preferred embodiment of the invention which can be installed in the inlet ramp ceiling of the boat shown in FIG. 1, to allow hull penetration by the driven shaft.

In accordance with the preferred embodiment of the invention, the driven shaft penetrates the hull via a through-hull housing assembly 42 installed in an opening formed in the inlet ramp. Referring to FIG. 2, the inlet ramp 8 comprises a pair of opposing side walls 44 (only one of which is visible in FIG. 2) which increase in height continuously from a starting point on the hull bottom 4 to the respective points where the side walls join the transom 6. The top edges of the opposing side walls 44 are connected by a ramp ceiling 46, which curves continuously upward. The side walls and ceiling form part of the molded hull bottom and define inlet channel 10. Optionally, the junctures connecting the side walls to the ceiling may be formed as rounded corners.

As seen in FIG. 2, the preferred embodiment of the invention comprises an assembly 42 installed in an opening in the hull bottom, i.e., in the ceiling 46 of the inlet ramp.

The assembly 42 comprises a through-hull housing 48, a clamp plate 50, a shaft shroud 52, a bellows 54, a face seal 56 and an inlet grate 58. The entire assembly may be installed in the hull as a module or may be assembled in place.

Preferably, the through-hull housing 48 is a thick plate made of metal (e.g., aluminum), structural plastic or reinforced fiberglass. The thick plate comprises a transverse linear bore 60 for passage of the driven shaft through the housing (and hull). The through-hull housing comprises a peripheral flange 62 which sits in a peripheral recess 64 formed along the edge of the opening in the inlet ramp ceiling 46. The recess preferably faces outward from the exterior of the hull. The through-hull housing 48 is clamped to the recessed hull edge, which forms the opening in the inlet ramp, by an annular clamp plate 50 which is preferably installed on the inboard side of the hull. The clamp plate 50 is fastened to the housing 48 by means of a plurality of bolts 51, with the edge of the hull opening being clamped therebetween. Preferably, a grooved mounting grommet 64 is fitted between the peripheral edge of the hull opening and the opposing surfaces of the through-hull housing 48 and clamp plate 50. The grommet 64 is preferably formed from a homogeneous material, e.g., nitrile. The (soft) durometer of nitrile allows the material to conform to the smooth exterior and to the inconsistent, rough interior. The hull material may require different thickness of the groove in the grommet. A fiber-reinforced plastic hull may have material thickness from 0.300 to 0.450 inch; an aluminum, hull may have plate material which is about 0.250 inch thick. The grommet material is squeezed between the clamped components, conforming to the interfacing surfaces to seal against water leaking into the hull via the housing/hull interface.

The preferred embodiment further comprises an inlet grate 58 extending from the outboard surface of the through-hull housing 48. The inlet grate 58 in accordance with the preferred embodiment shown in FIG. 2 is a separate component attached to the through-hull housing 48. The inlet grate 58 comprises a base 66 having a plurality of generally parallel cantilever tines 68 extending therefrom, the base 66 being fastened to the through-hull housing, e.g., by means of bolts 70. Alternatively, the housing and grate could be formed as one cast metal piece, e.g., made of aluminum alloy.

The tines 68 of the inlet grate extend across at least a portion of the inlet channel 10 for blocking the admission of weeds and/or other debris into the water jet propulsion assembly. As seen in FIG. 2, the length of the tines 68 is such that there is a gap between the ends of the tines and the lower lip 16 of the mounting adapter 14. This gap allows weeds or other debris to slide off the tines. Preferably the tines are tapered along their length, with the taper being dramatically increased near the free ends of the tines.

The outboard end of the linear bore 60 has an annular recess of increased diameter for receiving an end of a shaft shroud 52, which is press-fit into the annular recess. The shaft shroud 52 extends rearward and is coaxial with the linear bore. In the fully assembled state, the shaft shroud 52 surrounds the driven shaft as it traverses the inlet channel 10. The shaft shroud 52 prevents weeds, ropes or debris from becoming entangled around the rotating driven shaft. Preferably the shaft shroud is manufactured by swaging a tube. The swaged tube terminates in a flared conical section 71, which enhances the rearward hydrodynamic flow through the duct by diverting water radially outward immediately ahead of the rotating impeller hub. The swaged tube has an internal diameter greater than the outer diameter of the driven shaft, so that the latter may rotate freely inside the tube without rubbing against the shaft shroud. Similarly, the stationary flared conical section 71 is separated from the nose of the rotating impeller hub by a gap. This arrangement is not shown in the drawings.

Still referring to FIG. 2, the through-hull housing 48 in accordance with the preferred embodiment further comprises a boss 49 in the form of, a circular cylindrical extension integrally formed with the thick plate of the housing. The boss is coaxial with and penetrated by the linear bore 60. The preferred embodiment further comprises means, mounted to the boss 49, for preventing ingress of water into the hull via the linear bore 60. The means for preventing water ingress comprise a face seal 56 which is slid onto the driven shaft 26 until the face of the seal abuts a radial flange 57 on the shaft (not shown in FIG. 2). The face seal is effectively anchored to the boss 49 by means of a flexible bellows 54, which is also penetrated by the driven shaft. For example, one end of the bellows 54 is clamped onto the boss 49 by a first hose clamp 88, while the other end of the bellows is clamped onto the small-diameter portion of the face seal 56 by a second hose clamp 88. The bellows is preferably made of nitrile. The spring tension in the bellows pushes the face of the seal 56 against the radial flange 57, producing a surface pressure that prevents the ingress of water at the seal/flange interface.

The linear bore 60 is sized to provide sufficient clearance for the driven shaft to change its angular orientation by a small angle without contacting the bore wall. Thus there is an annular gap between the driven shaft and the linear bore, which gap, in the absence of sealing means, would provide a pathway for water to enter the hull. In accordance with the preferred embodiment of the invention, the face seal 56 provides the required seal. The face seal 56 is preferably made of high-density carbon/graphite which polishes the stainless steel face of the radial flange 57 during the initial minutes of operation. The polishing process ensures a perfect seal. The driven shaft is installed so that the radial flange 57 compresses or preloads the bellows 54. The flexible bellows, with the help of water pressure, produces a constant contact between the carbon face and the radial flange. This allows the face seal to compensate for the fore and aft movement in the driven shaft. The carbon face seal is bored larger than the shaft diameter to allow the seal to compensate for shaft vibration or misalignment. The face seal blocks ingress of water into the hull via the linear bore 60.

In accordance with the preferred embodiment, the drive shaft is coupled to the driven shaft by means of a flexible shaft coupling. The driven shaft is coupled to the impeller by a similar coupling. Flexible couplings are designed to allow the transmission of power between a drive shaft and a driven shaft, and usually include spline teeth which are in full contact along their flanks. These couplings permit axial displacement between the shafts, while maintaining a relatively constant bearing surface, and allow a limited amount of angular misalignment. The amount of misalignment depends upon the tooth shape and the amount of play between teeth and the drive and driven numbers. A flexible coupling is inexpensive and easy to replace, and requires no lubrication or periodic maintenance.

Figure 3:
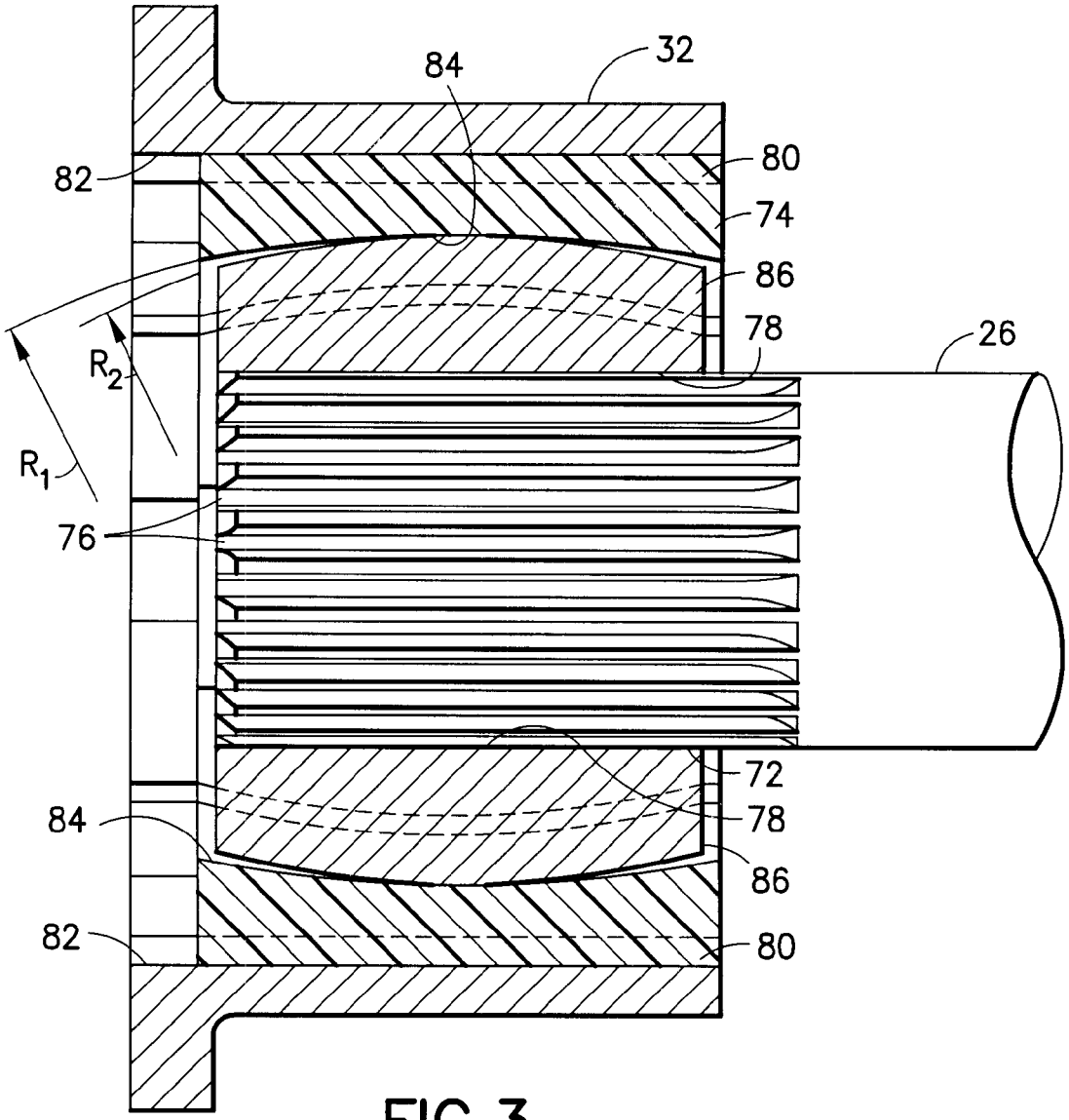
FIG. 3 is a schematic showing a sectional view of a known shaft coupling system which is incorporated in the preferred embodiment of the invention.

A known shaft coupling system is disclosed in U.S. Pat. No. 4,474,741. FIG. 3 depicts a preferred shaft coupling system for use in coupling the drive shaft 32 to the driven shaft 26, both shown in FIG. 1. This shaft coupling system comprises four main parts: driven shaft 26, a spline adapter 72, bushing 74, and drive shaft 32. The bushing 74 is made of a high-impact plastic, such as polyamide and polyamide-imide resins. Preferably the resin is of the class which is self-lubricating. The driven shaft 26, spline adapter 72 and drive shaft 32 are preferably made of steel. The use of different materials for the bushing and the adapter inhibits the tendency of the parts to mate together under load.

As depicted in FIG. 3, teeth 76 of the driven shaft 26 mate with recesses 78 of the spline adapter 72 in a slip-fit relationship. This allows axial movement of the shaft 26 with respect to the spline adapter 72, and thus allows for axial displacement. The bushing 74 is securely and substantially non-movably held within the drive shaft 32. This can be accomplished, for example, by providing teeth 80 on the bushing 74 which form an interference fit with recesses 82 on the drive shaft 32, i.e., the bushing is force-fit within the drive shaft. There is a slip-fit relation between adapter 72 and bushing 74.

As shown in FIG. 3, the surface of the spline adapter 72, i.e., the crowns of spline teeth 86, is formed to be arcuate in longitudinal axial cross section, having a radius of $R_2$. The inner surface of the bushing 74 is provided with a plurality of arcuately formed partcircular recesses 84 which intermesh with spline teeth 86. The bushing is formed so that, in its inner surface, a longitudinal arcuate groove is formed having radius $R_1$. The provision of this longitudinally curved surface permits the bushing 74 to hold the spline adapter 72 securely so that the spline adapter will not axially slide out of the bushing 74. The portion 32 could be directly machined on the drive shaft, or, as is well known in the art, the coupling could be executed by bolting a separate part onto the drive shaft via bolt holes, which could be provided in the outwardly extending flange. Unlike the spline teeth 86 of the spline adapter 72, the recesses 84 of the bushing 74 have a constant size and shape along the length of the bushing.

The shaft coupling shown in FIG. 3 accommodates axial displacement through slip-fit engagement of driven shaft 26 and adapter 72, and simultaneous angular misalignment between shafts 26 and 32 is accommodated through the difference between $R_1$ and $R_2$. Clearance at the ends of the coupling, necessary to accommodate the angular misalignment, is provided by the special spline tooth shape described above. The arcuate sides and substantially constant height of these teeth provide that an optimum and benign bearing surface will be provided, despite any angular misalignment.

In accordance with the preferred embodiment, the impeller is attached to the stator hub through a bearing. As a subassembly, the free-spinning impeller is borne by the stator to restrain the impeller from thrusting forward during operation. An aft coupling similar to the coupling shown in FIG. 3 can be used to couple the driven shaft to the impeller hub. The aft flexible coupling allows the angle and position of the driven shaft to be adjusted relative to the impeller hub.

Using flexible couplings, the driven shaft floats between the engine coupling and the impeller coupling, The angle and position of the driven shaft can be freely adjusted as a function of displacement of the motor 36 relative to the hull. The linear bore 60 of the through-hull housing 48 must be sized to allow sufficient clearance for transverse displacement of the driven shaft 26 during vertical displacement of the motor.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An assembly comprising:

a plate comprising a transverse linear bore comprising first and second sections, said first section having an internal diameter less than an internal diameter of said second section;

a linear tube comprising a first end which is inserted in said second section of said linear bore, said linear tube extending coaxial with said linear bore; and a grate supported by said plate and extending in cantilever fashion from said plate.

2. The assembly as recited in claim 1, wherein said linear tube further comprises a second end which is generally in the shape of a conical section.

3. The assembly as recited in claim 1, wherein said linear tube is formed by swaging.

4. The assembly as recited in claim 1, wherein said first end of said linear tube is press-fit into said second section of said linear bore.

5. The assembly as recited in claim 1, wherein said grate comprises a plurality of generally mutually parallel cantilever tines.

6. The assembly as recited in claim 1, wherein said plate comprises a boss penetrated by said linear bore.

7. The assembly as recited in claim 6, further comprising a face seal and a flexible bellows, a first end of said bellows being clamped to said boss and a second end of said bellows being clamped to said face seal.

8. A boat hull comprising an opening, a plate seated in said opening, a clamp plate, and a plurality of fasteners for fastening said clamp plate to said plate, said plate being clamped in said hull opening by said clamp plate and comprising a transverse linear bore, and said clamp plate comprising an opening placed so that said clamp plate does not interfere with said linear bore.

9. The boat hull as recited in claim 8, wherein said transverse linear bore comprises first and second sections, said first section having an internal diameter less than an internal diameter of said second section, further comprising a linear tube comprising a first end which is inserted in said second section of said linear bore, said linear tube extending coaxial with said linear bore and outside said hull.

10. The boat hull as recited in claim 9, wherein said linear tube further comprises a second end which is generally in the shape of a conical section.

11. The boat hull as recited in claim 9, wherein said linear tube is formed by swaging.

12. The boat hull as recited in claim 9, wherein said first end of said linear tube is press-fit into said second section of said linear bore.

13. The boat hull as recited in claim 8, further comprising a grate supported by said plate and extending in cantilever fashion outside said hull and away from said plate.

14. The boat hull as recited in claim 13, wherein said grate comprises a plurality of generally mutually parallel cantilever tines.

15. The boat hull as recited in claim 8, wherein said plate comprises a boss penetrated by said linear bore, further comprising a face seal and a flexible bellows, a first end of said bellows being clamped to said boss and a second end of said bellows being clamped to said face seal.

16. A boat comprising a hull, a motor mounted inside said hull, a drive shaft coupled to said motor, a driven shaft coupled to said drive shaft, a duct external to said hull and comprising an inlet and outlet, and an impeller mounted to said driven shaft and rotatable within said duct, wherein said driven shaft penetrates said hull via a through-hull housing installed in an opening in said hull, said through-hull housing comprising a transverse linear bore through which said driven shaft passes.

17. The boat as recited in claim 16, further comprising means for sealing an interface between a periphery of said through-hull housing and an edge of said hull opening.

18. The boat as recited in claim 16, further comprising means for sealing a gap between said driven shaft and said linear bore.

19. The boat as recited in claim 18, wherein said through-hull housing comprises a plate and a boss penetrated by said linear bore, and said sealing means comprise a face seal and a flexible bellows, a first end of said bellows being clamped to said boss and a second end of said bellows being clamped to said face seal.

20. The boat as recited in claim 16, wherein said transverse linear bore comprises first and second sections, said first section having an internal diameter less than an internal diameter of said second section, further comprising a linear tube comprising a first end which is inserted in said second section of said linear bore, said linear tube extending coaxial with said linear bore and outside said hull, said driven shaft passing through said linear tube.

21. The boat as recited in claim 20, wherein said linear tube further comprises an end which is generally in the shape of a conical section.

22. The boat as recited in claim 21, wherein said impeller comprises an impeller hub coupled to said driven shaft, said impeller hub comprising a nose separated from said conical section of said linear tube by a gap.

23. The boat as recited in claim 22, further comprising a flexible coupling for coupling an end of said driven shaft to said impeller hub.

24. The boat as recited in claim 16, further comprising a flexible coupling for coupling an end of said drive shaft to an end of said driven shaft.

25. The boat as recited in claim 16, further comprising a grate supported by said plate and extending in cantilever fashion across at least a portion of said duct inlet.

26. A boat comprising:

a hull comprising a bottom, a stern wall, and an inlet ramp starting on said hull bottom and extending to said stern wall, said inlet ramp defining an inlet channel and comprising an opening;

a through-hull housing installed in said opening in said inlet ramp, said through-hull housing comprising a transverse linear bore;

a duct mounted to said stern wall and extending rearward therefrom in cantilever fashion, said duct comprising an inlet and an outlet, said duct inlet being adjacent an end of said inlet channel;

a motor mounted inside said hull;

a drive shaft coupled to said motor;

a driven shaft coupled to said drive shaft, passing through said linear bore, and rotatably supported within said duct; and an impeller mounted to said driven shaft for impelling water out said duct outlet.

27. The boat as recited in claim 26, wherein said through-hull housing comprises a plate and a boss penetrated by said linear bore, further comprising a face seal and a flexible bellows, a first end of said bellows being clamped to said boss and a second end of said bellows being clamped to said face seal.

28. The boat as recited in claim 26, further comprising a linear tube comprising one end which is attached to said through-hull housing and another end separated from said impeller by a gap, said linear tube extending coaxial with said linear bore, and said driven shaft passing through said linear tube.

29. The boat as recited in claim 26, further comprising a weed grate supported by said plate and extending in cantilever fashion across at least a portion of said inlet channel.

30. The boat as recited in claim 29, wherein said weed grate comprises a plurality of generally mutually parallel tines.

* * * * *